US012774560B2

(12) United States Patent
Auer et al.

(10) Patent No.: US 12,774,560 B2
(45) Date of Patent: Oct. 27, 2026

(54) METHOD FOR SUCTIONING FIBERS FROM A PULP USING A SUCTION DEVICE WITH A SUCTION TOOL

(71) Applicant: Kiefel GmbH, Freilassing (DE)

(72) Inventors: Thomas Auer, Saaldorf-Surheim (DE); Hubert Rehrl, Teisendorf (DE); Josef Rehrl, Teisendorf (DE); Heinz Neuhofer, Freilassing (DE)

(73) Assignee: Kiefel GmbH, Freilassing (DE)

( * ) Notice: Subject to any disclaimer, the term of this patent is extended or adjusted under 35 U.S.C. 154(b) by 154 days.

(21) Appl. No.: 18/666,138

(22) Filed: May 16, 2024

(65) Prior Publication Data

US 2024/0384468 A1 Nov. 21, 2024

(30) Foreign Application Priority Data

May 16, 2023 (DE) ..... 10 2023 112 891.4

(51) Int. Cl.
*D21F 1/48* (2006.01)

(52) U.S. Cl.
CPC ..... *D21F 1/48* (2013.01)

(58) Field of Classification Search
CPC ..... D21F 1/48; D21J 7/00; D21J 3/10
See application file for complete search history.

(56) References Cited

U.S. PATENT DOCUMENTS

| | | | | |
|---|---|---|---|---|
| 2,925,863 | A | 2/1960 | Chaplin | |
| 3,449,207 | A | 6/1969 | Modersohn | |
| 5,656,135 | A | 8/1997 | Baker | |
| 2003/0051845 | A1* | 3/2003 | Gale | D21J 7/00 162/224 |
| 2022/0242015 | A1* | 8/2022 | Bontrager | D21J 3/00 |

FOREIGN PATENT DOCUMENTS

WO 2023/170425 A1 9/2023

OTHER PUBLICATIONS

Search Report in German Appl. No. 10 2023 112 891.4 mailed Mar. 19, 2024, 5 pages.
Extended European Search Report in Appl. No. 24175323.5 mailed Jul. 9, 2025, 9 pages.

* cited by examiner

*Primary Examiner* — Rita P Adhlakha
*Assistant Examiner* — Elisa H Vera
(74) *Attorney, Agent, or Firm* — Kowert, Hood, Munyon, Rankin & Goetzel, P.C.; Gareth M. Sampson; Dean M. Munyon

(57) ABSTRACT

A method for suctioning fibers from a pulp using a suction device with a suction tool, and a suction device for suctioning fibers from a pulp with a suction tool that has a plurality of cavities for suctioning fibers are described.

6 Claims, 3 Drawing Sheets

METHOD FOR SUCTIONING FIBERS FROM A PULP USING A SUCTION DEVICE WITH A SUCTION TOOL

PRIORITY CLAIM

The present application claims priority under 35 U.S.C. § 119 to German Patent Application No. DE 10 2023 112 891.4, filed May 16, 2023, the disclosure of which is incorporated by reference herein in its entirety.

TECHNICAL FIELD

Methods for suctioning fibers from a pulp using a suction device with a suction tool, and suction devices for suctioning fibers from a pulp with a suction tool that has a plurality of cavities for suctioning fibers are described.

DESCRIPTION OF RELATED ART

Fiber-containing materials are increasingly used, for example, to produce packaging for food (e.g., trays, capsules, boxes, etc.) and consumer goods (e.g., electronic devices, etc.) as well as beverage containers. Everyday items, such as disposable cutlery and tableware, are also made from fiber-containing material. Fiber-containing materials contain natural fibers or artificial fibers. Recently, fiber-containing material is increasingly used that has or is made of natural fibers that can be obtained, for example, from renewable raw materials or waste paper. The natural fibers are mixed in a so-called pulp with water and optionally further additives, such as starch. Additives can also have an effect on color, barrier properties and mechanical properties. This pulp can have a proportion of natural fibers of, for example, 0.1 to 10 wt. %. The proportion of natural fibers varies depending on the method used for the production of packaging etc. and the product properties of the product to be produced.

The production of fiber-containing products from a pulp generally takes place in a plurality of work steps. For this purpose, a fiber processing device has a plurality of stations or forming stations. In a forming station, for example, fibers can be suctioned in a cavity of a suction tool, thus forming a preform. For this purpose, the pulp is provided in a pulp supply, and the suction tool is at least partially immersed in the pulp with at least one suction cavity whose geometry essentially corresponds to the product to be manufactured. During the immersion, suction takes place via openings in the suction cavity, which are connected to a corresponding suction device, where fibers from the pulp accumulate on the surface of the suction cavity. The suctioned fibers (fiber cake) can subsequently be brought into a pre-pressing tool via the suction tool, where a preform is pre-pressed. For this purpose, for example, it is possible to use elastic mold bodies that are inflated in order to press and, in the process, exert pressure on the preforms. During this pre-pressing process, the fibers in the preform are compressed and the water content of the preform is reduced. After this, preforms are pressed in a hot press to form finished molded parts. In this process, preforms are inserted into a hot press tool that has, for example, a lower tool half and an upper tool half that are heated. In the hot press tool, the preforms are pressed in a cavity under heat input, with residual moisture being removed by the pressure and heat so that the moisture content of the preforms is reduced from about 60 wt. % before hot pressing to, for example, 5-10 wt. % after hot pressing.

A suction tool and a manufacturing method using the methods described above are known, for example, from DE 10 2019 127 562 A1.

For the so-called wet fiber process, a so-called fiber cake is pre-formed from the pulp (cellulose/water mixture) for further processing. This preforming is usually done by suction by means of negative pressure from aqueous pulp (primary molding). The aqueous mixture adheres to a filter net during suction, where the cellulose fibers in the mold insert (suction cavity) form the fiber cake, and the excess water of the mixture is transported through a net/membrane that forms the surface of the suction cavity, and is thus separated from the cellulose. The remaining water bound in the fiber cake is separated mechanically in further steps by pressing or evaporation. In order to ensure that the cycle of further processing is uniform in terms of quality and with a plurality of mold inserts, uniform material distribution in the cavities of a suction tool is already of great importance during suction.

For molding tools with more than one mold insert and mold cavities on the same level parallel to the pulp surface of a pulp container, the effective volume flow fluctuates greatly due to the statistically greater or lesser access/distance to the pulp at a uniform suction negative pressure. Mold cavities that are located at the edge regions of a suction tool due to the shape of the suction box first fill their mold cavity at a constant negative pressure via a suction unit, where the entire volume flow is subsequently available to the inner mold cavities when the outer cavities are "closed" and is then abruptly filled with more material (fibers) and a higher relative volume flow. This difference can only be compensated for with a long waiting time below the pulp level, where the cycle time for the process step increases enormously, which has a negative effect on the production time of molded parts made of fiber-containing material. The weight distribution of the individual fiber cakes in the suction tools therefore varies greatly at the end of a suction process.

SUMMARY

Object

Thus, it is an object of the present disclosure to specify a solution that provides a suctioning of fibers from a pulp, where a uniform fiber cake formation is achieved for suctioning fibers over a plurality of cavities, regardless of the position of the cavities, where a uniform weight/material distribution of sucked fibers is achieved for all cavities during a suction process. In addition, the cycle time for the suction of fibers for this purpose should not be extended compared to conventional suction processes.

Solution

The aforementioned object is achieved by a method for suctioning fibers from a pulp using a suction device with a suction tool that has a plurality of cavities, where the cavities have a surface with a plurality of openings, which are connected to a common suction line via channels, where the suction power is changed during a suction process.

By selectively changing the suction power, changing pressure levels and volume flows and/or positioning the cavities at different levels relative to the pulp surface, the suction volume flow can be influenced in such a way that the material distribution is uniform with a comparatively shorter cycle time. Outer mold cavities can still clog first over time during the suction process. As soon as the effective volume flow and the build-up of material then shifts to the inner mold cavities, the volume flow and a suction (vacuum) pressure can be switched over, as a result of which, for example, the middle cavities clog less strongly or evenly relative to the outer cavities.

This can, for example, involve switching between at least two states, or the suction tool is moved in relation to the pulp surface. Advantageously, this allows material to be distributed evenly regardless of the position of the cavities in a suction tool without sacrificing cycle time.

The term "channels" also includes spaces through which suction can take place so that no restriction to specific geometries or extensions is to be understood in this regard.

In further embodiments, a negative pressure can be generated in the cavities for suction, where the negative pressure for suction has at least two different states. This means that after reaching a determinable state with regard to the clogging of the cavity surface or after a period of time, a switchover can take place so that the suction effect on the already clogged cavities decreases due to the different pressure states, and thus only little/no further material is deposited there, whereas the relatively free cavities have a sufficient suction effect.

In other embodiments, the suction power can be changed continuously or in stages. In particular, this allows a very precise distribution to be achieved, since the clogging is adjusted either continuously or in stages.

In other embodiments, the change in suction power can be changed automatically or manually. An automatic change can, for example, be specified in accordance with previously determined suction times and pressures or undertaken based on measured information. A manual change can be adapted and/or changed, for example, by entering process or product information.

In further embodiments, the change in the suction power can be controlled or regulated in accordance with the geometry of the cavities, the position of the cavities in the suction tool, the suction duration, the pulp composition, pulp properties and/or pulp temperature, the weight of fibers already sucked, the clogging of the cavities, etc. The arrangement of the cavities can be taken into account—for example, cavities can be arranged in a circle around a central cavity, which results in a change in stages in suction power from the outside to the inside. The same also applies, for example, to a suction tool with a plurality of cavities, where these form rectangular groups that, for example, surround an inner cavity core like a frame. The suction power can be changed for each group/frame in accordance with the distance from the center or the edge.

In further embodiments, at least one of the aforementioned states or properties can be monitored and, after reaching limit values, a change in the suction power can be initiated via the control device. For this purpose, sensor units can be provided that, for example, ascertain a changed volume flow during a suction process in the event of clogging and, depending on the value, initiate a change.

The aforementioned object is also achieved by a suction device for suctioning fibers from a pulp with a suction tool that has a plurality of cavities for suctioning fibers, where the cavities have a surface with a plurality of openings that are connected via channels to a common suction line, having a control device via which the suction power can be varied during a suction process.

The suction device can be used to achieve uniform weight/material distribution at the individual cavities in a wet fiber process. This can ensure that a uniform product quality of molded parts made of a fiber containing material is achieved in a subsequent in hot pressing process. The drying time is determined according to the cavity with the highest material weight (fiber cake; preform), so that there are no differences in the results of hot-pressed/dried molded parts with the same material weight.

This results in a reduction of scrap and a reduction of the cycle time, because there are no (large) material fluctuations in the fiber cakes/preforms. In the operation of a fiber processing device with a suction device, the drying time is determined corresponding to the cavity with the greatest material weight, where smaller differences consequently result in a more even run and a significantly improved quality of the produced molded parts.

In further embodiments, the control device can have at least one valve, which is designed to change the cross-section of the common suction line in order to change the suction power. In other embodiments, for example, switching between pressure levels can be achieved by throttling (eliminating pressure) in a bypass, as well as with a plurality of base pressures or leakage air via a bypass.

For example, a bypass valve can be arranged in the common suction line, which can throttle the effective volume flow during suction via the adjustable cross-section.

In further embodiments, the suction device can have at least one sensor unit for monitoring at least the suction pressure in the channels and/or the suction line, the suction duration, the pulp composition, pulp properties and/or pulp temperature, the weight of fibers already sucked, the clogging of the cavities, where the at least one sensor unit is connected to the control device, that is designed to carry out a change in the suction power in accordance with the feedback output by the at least one sensor unit. This means that the suction power can be switched or changed depending on the actual state of suction so that the product quality of the molded parts to be produced is further improved.

Further features, embodiments and advantages result from the following illustration of exemplary embodiments with reference to the figures.

DETAILED DESCRIPTION

Various embodiments of the technical teaching described herein are shown below with reference to the figures. Identical reference signs are used in the figure description for identical components, parts and processes. Components, parts and processes that are not essential to the technical teachings disclosed herein or that are obvious to a person skilled in the art are not explicitly reproduced. Features specified in the singular also include the plural unless explicitly stated otherwise. This applies in particular to statements such as "a" or "one."

Figure 1:
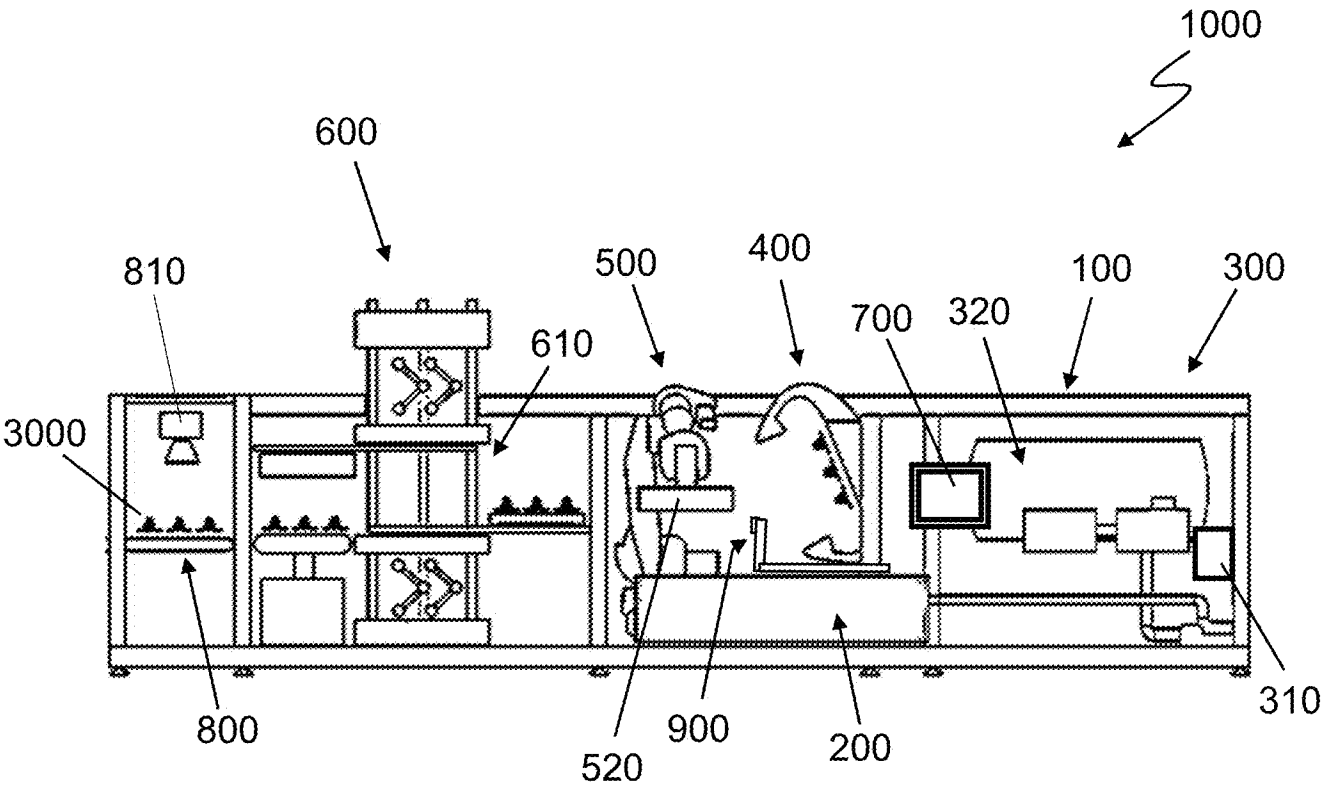
FIG. 1 depicts a schematic representation of a fiber processing device, according to some embodiments.

FIG. 1 shows a schematic representation of a fiber processing device 1000 for producing three-dimensional molded parts from a fiber-containing material, according to some embodiments. In the illustrated embodiment, the fiber-containing material for the production of molded parts is processed in a pulp tank 200 of the fiber processing device 1000. For this purpose, water and fibrous materials as well as additives, if any, can be introduced into a pulp tank 200 via a liquid supply, and the pulp can be prepared in the pulp tank 200 by mixing the individual components with heat input and by auxiliary means, such as an agitator.

Pulp refers to an aqueous solution containing fibers, where the fiber content of the aqueous solution can be in a range of 0.1 to 10 wt. %. In addition, additives such as starch, chemical additives, wax, etc. can be present. The fibers can be, for example, natural fibers, such as cellulose fibers, or fibers from a fiber-containing original material (for example waste paper). A fiber treatment plant offers the possibility of preparing pulp in a large quantity and providing pulp to a plurality of fiber processing devices 1000.

The fiber processing device 1000 can be used to produce, for example, biodegradable cups 3000, capsules, trays, plates, and other molded and/or packaged parts (e.g., as holder/supporting structures for electronic appliances). Since a fibrous pulp with natural fibers is used as the starting material for the products, the products manufactured in this way can themselves be used as a starting material for the manufacture of such products after their use, or they can be composted, because they can usually be completely decomposed and do not contain any substances that are harmful to the environment.

The fiber processing device 1000 shown in FIG. 1 has a frame 100 that can be surrounded by a cladding. The supply units 300 of the fiber processing device 1000 include, for example, interfaces for the supply of media (for example, water, pulp, compressed air, gas, etc.) and energy (power supply), a central control unit 310, at least one suction device 320, line systems for the various media, pumps, valves, lines, sensors, measuring devices, a bus system, etc., and interfaces for bidirectional communication via a wired and/or wireless data connection. Instead of a wired data connection, there can also be a data connection via a fiber optic line. The data connection can be, for example, between the control unit 310 and a central controller for a plurality of fiber processing devices 1000, to a fiber preparation plant, to a service point, and/or further devices. It is also possible to control the fiber processing device 1000 via a bidirectional data connection via a mobile device, such as a smartphone, tablet computer, or the like.

The control unit 310 is in bidirectional communication with an HMI panel 700 via a bus system or a data connection. The HMI (Human Machine Interface) panel 700 has a display that displays operating data and states of the fiber processing device 1000 for selectable components or the entire fiber processing device 1000. The display can be designed as a touch display so that adjustments can be made manually by an operator of the fiber processing device 1000. Additionally or alternatively, further input means, such as a keyboard, a joystick, a keypad, etc. for operator inputs, can be provided on the HMI panel 700. In this way, settings can be changed and the operation of the fiber processing device 1000 can be influenced.

The fiber processing device 1000 has a robot 500. The robot 500 is designed as a so-called 6-axis robot and is thus able to pick up parts within its radius of action, to rotate them and to move them in all spatial directions. Instead of the robot 500 shown in the figures, other handling devices can also be provided that are designed to pick up and twist or rotate products and move them in the various spatial directions. In addition, such a handling device may also be otherwise configured, in which case the arrangement of the corresponding stations of the fiber processing device 1000 may differ from the illustrated embodiment.

A suction tool 520 is arranged on the robot 500. In the illustrated embodiment, the suction tool 520 has cavities (e.g., cavities 350, shown in FIG. 2) formed as negatives of the three-dimensional molded parts to be formed, such as of cups 3000, as suction cavities. The cavities can have, for example, a net-like surface on which fibers from the pulp are deposited during the suction. Behind the net-like surfaces, the cavities are connected to a suctioning device via channels in the suction tool 520. The suction device can be realized, for example, by a suction device 320. Pulp can be suctioned in via the suction device when the suction tool 520 is located within the pulp tank 200 in such a way that the cavities are at least partially located in the aqueous fiber solution, the pulp. A vacuum, or a negative pressure, for suctioning fibers, when the suction tool 520 is located in the pulp tank 200 and the pulp, can be provided via the suction device 320. For this purpose, the fiber processing device 1000 has corresponding means at the supply units 300. The suction tool 520 has lines for providing the vacuum/negative pressure from the suction device 320 in the supply units 300 to the suction tool 520 and the openings in the cavities. Valves are arranged in the lines, which can be controlled via the control unit 310 and thus regulate the suction of the fibers. It is also possible for the suction device 320 to perform a "blow-out" instead of a suction, for which purpose the suction device 320 is switched to another operating mode in accordance with its design.

In the production of molded parts made of a fiber material, the suction tool 520 is immersed in the pulp and a negative pressure/vacuum is applied to the openings of the cavities so that fibers are suctioned out of the pulp and are deposited for example on the net of the cavities of the suction tool 520.

Thereafter, the robot 500 lifts the suction tool 520 out of the pulp tank 200 and moves said tool together with the fibers that are adhering to the cavities and still have a relatively high moisture content of, e.g., over 80 wt. % water, to the pre-pressing station 400 of the fiber processing device 1000, where the negative pressure is maintained in the cavities for the transfer. The pre-pressing station 400 has a pre-pressing tool with pre-pressing molds. The pre-pressing molds can be formed, for example, as positive of the molded parts to be manufactured and have a corresponding size with regard to the shape of the molded parts for receiving the fibers adhering in the cavities.

In the production of molded parts, the suction tool 520 is moved, with the fibers adhering in the cavities, to the pre-pressing station 400 in such a way that the fibers are pressed into the cavities. The fibers are pressed together in the cavities, so that a stronger connection is thereby produced between the fibers. In addition, the moisture content of the preforms formed from the suctioned-in fibers is reduced, so that the preforms formed after the pre-pressing only have a moisture content of, for example, 60 wt. %. To squeeze out water, flexible pre-pressing molds can be used, which are inflated, for example, by means of compressed air (process air), thereby pressing the fibers against the wall of a cavity of a further suction tool part. As a result of the "inflation," both water is squeezed out, and the thickness of the sucked-in fiber layer is reduced.

During pre-pressing, liquid or pulp can be extracted and returned via the suction tool 520 and/or via further openings in pre-pressing molds or pre-pressing tool parts (cavities). The liquid or pulp discharged during suction via the suction tool 520 and/or during pre-pressing in the pre-press station 400 can be returned to the pulp tank 200.

After pre-pressing in the pre-pressing station 400, the preforms produced in this way are moved to a hot pressing station 600 on the suction tool 520 via the robot 500. For this purpose, the negative pressure is maintained at the suction tool 520 so that the preforms remain in the cavities. The preforms are transferred via the suction tool 520 to a lower tool body that can be moved along the production line out of the hot pressing device 610. If the lower tool body is in its extended position, the suction tool 520 is moved to the lower tool body in such a way that the preforms can be placed on forming devices of the lower tool body. Subsequently, an overpressure is produced via the openings in the suction tool 520 so that the preforms are actively deposited by the cavities, or the suction is ended, so that the preforms remain on the forming devices of the lower tool body due to gravity. By providing overpressure at the openings of the cavities, pre-pressed preforms that rest/adhere in the cavities can be released and dispensed.

Thereafter, the suction tool 520 is moved away via the robot 500 and the suction tool 520 is dipped into the pulp tank 200 in order to suction further fibers for the production of molded parts from fiber-containing material.

After the transfer of the preforms, the lower tool body moves into the hot pressing station 600. In the hot pressing station 600, the preforms are pressed into finished molded parts under heat and high pressure, for which purpose an upper tool body is brought onto the lower tool body via a press. The upper tool body has cavities corresponding to the forming devices. After the hot pressing operation, the lower tool body and the upper tool body are moved away relatively from one another and the upper tool body is moved along the fiber processing device 1000 in the manufacturing direction, where after the hot pressing the manufactured molded parts are suctioned in via the upper tool body and thus remain within the cavities. Thus, the manufactured molded parts are brought out of the hot pressing station 600 and deposited via the upper tool body after the deposition on a transport belt of a conveyor device 800. After the deposition, the suction via the upper tool body is ended and the molded parts remain on the transport belt. The upper tool body moves back into the hot pressing station 600 and a further hot pressing operation can be carried out.

The fiber processing device 1000 further has a conveying device 800 with a transport belt. The manufactured molded parts made of fiber-containing material can be placed on the transport belt after the final molding and the hot pressing in the hot pressing station 600 and discharged from the fiber processing device 1000. In further embodiments, after placing the molded parts on the transport belt of the conveying device 800, further processing can take place, such as filling and/or stacking the products. The stacking can take place, for example, via an additional robot or another device.

The fiber processing device 1000 from FIG. 1 shows a possible embodiment. A fiber processing device according to the technical teaching described herein can also have only one forming station with a replaceable tool, e.g., a suction tool 520 or a hot press tool, in which fiber-containing material can be processed, it being possible for different tools for producing different three-dimensional molded parts to be received in the at least one forming station. The further stations and devices shown for the fiber processing device 1000 of FIG. 1 are not absolutely necessary for implementing the technical teaching.

Figure 2:
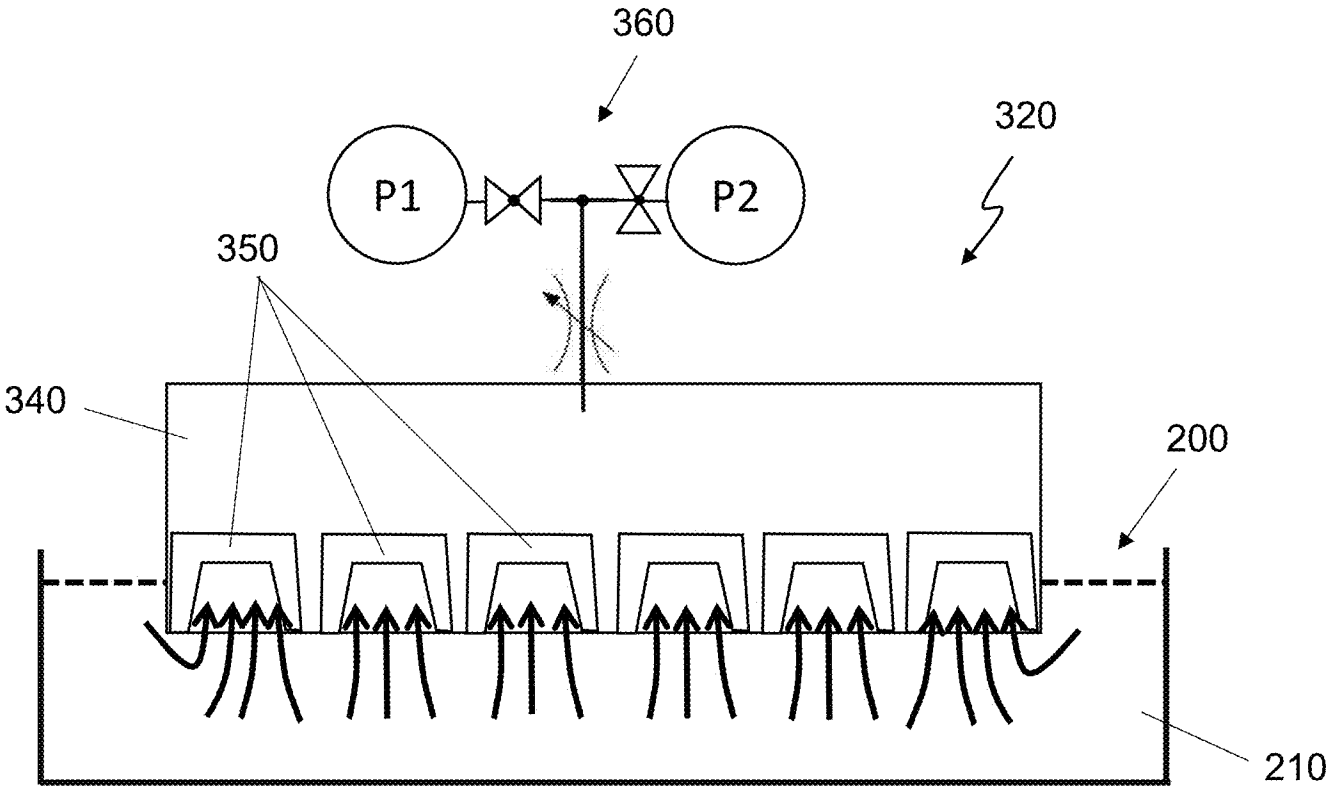
FIG. 2 depicts a schematic representation of a suction process with a suction device, according to some embodiments.

FIG. 2 shows a schematic representation of a suction process with a suction device 320, according to some embodiments. The suction device 320 has a suction tool 340 with a plurality of cavities 350. The arrangement of the cavities 350 in the underside of the suction tool 340 can be as shown schematically in FIG. 3 for various tool designs. In further embodiments, cavities 350 can also be round, oval or polygonal instead of rectangular in cross-section when viewed from the underside of the suction tool 340. In still further embodiments, cavities of suction tools 340 can be arranged in a circle or polygon.

In the illustrated embodiments, the cavities 350 have a net-like structure on the inner suction surface. Channels extend from the net-like structure within the suction tool 340, which converge in a common suction line for all channels of the cavities 350. A negative pressure is applied via the common suction line to suck fibers when the suction tool 340 is located in the pulp 210 in such a way that the fibers can be sucked over the inner surface of the cavities 350.

The suction line is connected to a control device 360, which has a throttle valve in the illustrated embodiment. The cross-section of the suction line can be changed via the throttle valve so that in the schematically shown example, two different pressure states P1 and P2 can be set for the suction of fibers from the pulp 210. For suction, a negative pressure is provided via the common suction line and the control device, which can be P1=0.3 to 0.6 bar absolute pressure, for example in an initial state, i.e. at the start of the suction process. After a definable time interval when the outer cavities 350 are relatively heavily clogged, i.e. a relatively large quantity of fibers has already deposited on the cavity surface, the throttle valve is actuated via the control device 360 so that the cross-section of the suction line is changed. This changes the suction pressure, which is then P2 in the illustrated embodiment. The suction negative pressure P2 can be between 0.7 and 0.9 bar absolute pressure, for example. In still further embodiments, the pressure can be changed in stages or continuously, e.g. by changing the free cross-section in the suction line. In addition to a time specification for switching between the pressure states P1 and P2, the suction negative pressure can be set in accordance with the information from at least one sensor unit, which, for example, ascertains the volume or mass flow in the suction line and transmits it to the control device 360. As soon as the volume or mass flow exceeds at least one limit value, the suction pressure can be switched to at least one other pressure level, or the suction negative pressure can be continuously changed.

In still further embodiments, a change in the suction pressure can additionally or alternatively occur by displacing the suction tool 320 relative to the pulp surface in the pulp tank 200. It is essential for the cavities 350 to lie in a plane and for the suction tool 320 with the cavities 350 to be displaced parallel to the surface so that the resulting changed pressure situation has the same effect on all cavities 350. This also applies to suction in the pulp tank 200 in general, where a suction pressure can only act uniformly if the pressure situation in the cavities 350 is the same (i.e., for example, no inclined immersion of the suction tool 320, etc.).

The pressure change due to a displacement of the suction tool 320 during the suction process can, for example, be continuous or in stages, where at least two stages can be provided.

In the illustrated embodiment, the pulp 210 can be present, for example, as an aqueous fiber mixture in concentrations of 0.2-1.5 wt. % of fibers in a pulp basin 200, from which the suction tool 320 sucks the required amount of pulp 210 or fibers, as shown schematically in FIG. 2 by the arrows. The arising suction volume flow is substantially dependent on the shape and arrangement of the cavities 350 of the suction tool 320.

After the start of the suction process, the outer cavities 350 close first. One reason for this is that more fiber material can be fed over the entire lower surface of the suction tool 320 in the outer region. In the inner cavities 350, the amount of sucked fiber material is smaller, because more cavities 350 are arranged in the immediate vicinity that also suck fiber material. As soon as the outer cavities 350 have sucked a sufficient quantity of fibers, the inner cavities 350 would suddenly suck more fiber material if the initial suction negative pressure is maintained, so that these would ultimately have the most material. Therefore, after a predeterminable period of time or, as indicated above, by measuring parameters, at least one switchover is performed so that the suction negative pressure is reduced. This ensures that the inner cavities 350 do not clog excessively. As a result, uniform clogging of all cavities 350 is achieved.

Figure 3:
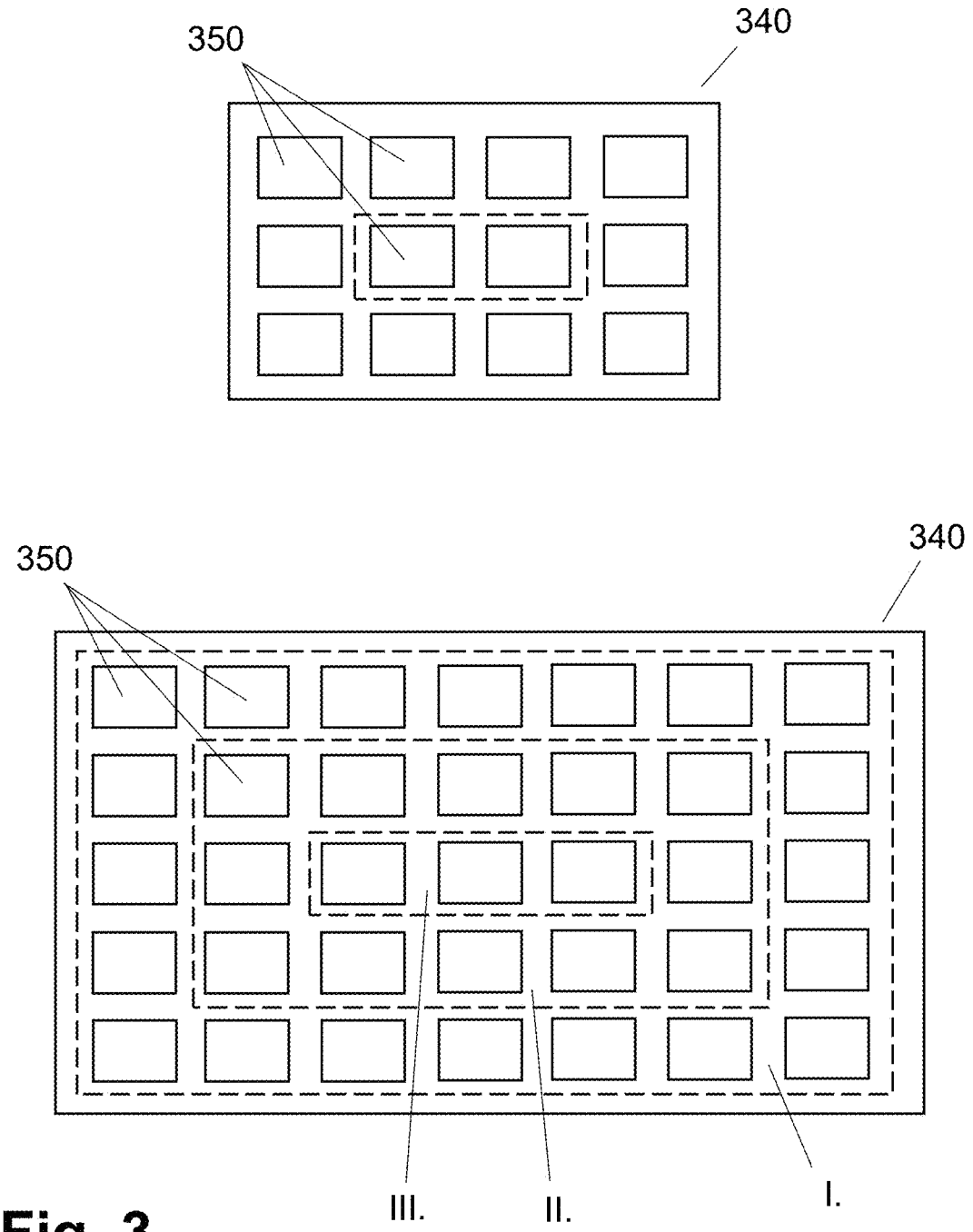
FIG. 3 depicts a schematic representation of the arrangement of cavities, according to some embodiments.

FIG. 3 shows the undersides of suction tools 320 with a plurality of cavities 350, according to some embodiments. In the above example, the suction tool 320 has two inner cavities 350 and ten outer cavities 350. The dashed line surrounds the inner cavities 350 and illustrates the two different cavity groups. Two different suction pressures (see P1 and P2) are sufficient with regard to the method described above and switching.

In the lower example in FIG. 3, the underside of a suction tool 320 is shown, which has three groups I., II., III. of cavities 350. This suction tool 320 can, for example, be switched in stages for each of the groups I, II and III. As explained above, the switchover can take place depending on the time or after exceeding or falling below limit values, which are compared with parameters that are ascertained by at least one sensor unit and transmitted to the control device 360. The control device 360 can change, for example, the opening cross-section of a common suction line via a valve or other device as a result of the transmitted information or by a specification. In the example in FIG. 3, for example, the cavities 350 of group I. are clogged first. For this purpose, the initial suction negative pressure is changed after an initial time interval. Subsequently, the clogging of group II. of the cavities 350 increases so that after a second time interval, the changed suction negative pressure is changed again, where finally the cavities 350 of the third group in the middle of the suction tool 320 clog, and the sucked fiber material the cavities 350 has the final weight or quantity of fibers.

With the aid of adjusting the suction power (e.g., suction negative pressure) of a suction tool 320 described herein and the design of a suction tool 320, a significant improvement of the suction in a fiber molding process (wet fiber process) can be achieved, where all cavities 350 of a multi-cavity suction tool 320, which has at least one inner and an outer suction cavity 350, have a uniform fiber distribution so that the sucked fiber cakes and finally preforms and final molded parts do not have any significant differences in weight and material. This benefits downstream manufacturing processes in particular, such as for example hot pressing in a hot pressing station 600, because the introduced thermal energy leads to uniform heating of all preforms, since they do not have different weights and therefore different amounts of water.

LIST OF REFERENCE SIGNS

100 Frame
200 Pulp tank
210 Pulp
300 Supply units
310 Control unit
320 Suction device
340 Suction tool
350 Cavity
360 Control device
400 Pre-pressing station
500 Robot
520 Suction tool
600 Hot pressing station
610 Hot pressing device
700 HMI panel
800 Conveying device
810 Camera
1000 Fiber processing device
3000 Cup

The invention claimed is:

1. A method for suctioning fibers from a pulp using a suction device with a suction tool that has a plurality of cavities, wherein the cavities have surfaces with openings, the openings being connected to a common suction line via channels, wherein a suction power provided to the suction tool is changed during a suction process by reducing the suction power through operation of the suction device in response to clogging of at least some of the cavities.

2. The method according to claim 1, wherein a negative pressure is generated in the cavities for suction, and the negative pressure for suction has at least two different states.

3. The method according to claim 1, wherein the suction power is changed continuously or in stages.

4. The method according to claim 1, wherein the change in suction power is changed automatically or manually.

5. The method according to claim 1, wherein the change in the suction power is controlled in accordance with at least one of the following parameters: a geometry of the cavities, a position of the cavities in the suction tool, a suction duration, a pulp composition, pulp properties and/or pulp temperature, a weight of fibers already sucked, and a clogging of the cavities.

6. The method according to claim 5, wherein at least one of the parameters is monitored and, when limit values are reached, a change in the suction power is initiated via a control device.

* * * * *